US010100542B2

(12) United States Patent
GangaRao et al.

(10) Patent No.: US 10,100,542 B2
(45) Date of Patent: Oct. 16, 2018

(54) DURABLE, FIRE RESISTANT, ENERGY ABSORBING AND COST-EFFECTIVE STRENGTHENING SYSTEMS FOR STRUCTURAL JOINTS AND MEMBERS

(71) Applicant: West Virginia University, Morgantown, WV (US)

(72) Inventors: Hota V. S. GangaRao, Morgantown, WV (US); Praveen K. R. Majjigapu, Morgantown, WV (US)

(73) Assignee: West Virginia University, Morgantown, WV (US)

( * ) Notice: Subject to any disclaimer, the term of this patent is extended or adjusted under 35 U.S.C. 154(b) by 0 days.

(21) Appl. No.: 15/446,022

(22) Filed: Mar. 1, 2017

(65) Prior Publication Data

US 2017/0321422 A1 Nov. 9, 2017

Related U.S. Application Data

(62) Division of application No. 15/147,124, filed on May 5, 2016, now Pat. No. 9,611,667.

(51) Int. Cl.
*E04C 5/07* (2006.01)
*E04G 23/02* (2006.01)
(Continued)

(52) U.S. Cl.
CPC ..... *E04G 23/0218* (2013.01); *E04C 5/07* (2013.01); *E04G 23/02* (2013.01);
(Continued)

(58) Field of Classification Search
CPC ..... E04C 5/07; E04G 23/02; E04G 23/0203; E04G 2023/0251
See application file for complete search history.

(56) References Cited

U.S. PATENT DOCUMENTS 1,727,117 A * 9/1929 Slidell ..... E04B 2/56 52/272
2,090,588 A * 8/1937 Witsell ..... A47K 3/008 4/538
(Continued)

FOREIGN PATENT DOCUMENTS

DE 29505828 U1 * 8/1996 ..... E04F 19/0486
DE 29610162 U1 * 8/1996 ..... E04F 21/165
(Continued)

OTHER PUBLICATIONS

Naamna, A, Park, S, Lopez, M and Stankiewicz, P, "Glued on Fiber Reinforced Plastic (FRP) Sheets of Repair and Rehabilitation", Report No. UMCEE 97-12, University of Michigan, Aug. 1997.
(Continued)

*Primary Examiner* — Jeanette E Chapman
(74) *Attorney, Agent, or Firm* — Dinsmore & Shohl LLP; Monika L'Orsa Jaensson, Esq.

(57) ABSTRACT

The disclosed technology is a system and a method for strengthening one or more joints of a structure having a plurality of structural members forming a vacuous area at each joint. The method includes computing limit load bearing capacity for the structure, at a joint, securing a filler module to the joint, at the vacuous area, the filler module having a plurality of surfaces so that when secured within the vacuous area, some of the surfaces are tangential to the members of the structure at its joint, and one or more of the surfaces are non-tangential to the members of the structure, and applying at least one layer of continuous fiber reinforced polymer wrap about the filler module and the members at the joint. The filler module of the disclosed technology is designed and configured to dissipate energy from a load applied to the structure, and at least doubling the load bearing capacity for the structure, at the joint.

20 Claims, 4 Drawing Sheets

(51) Int. Cl.
*E01D 19/00* (2006.01)
*E01D 22/00* (2006.01)

(52) U.S. Cl.
CPC ..... *E04G 23/0203* (2013.01); *E01D 19/00* (2013.01); *E01D 22/00* (2013.01); *E04G 2023/0251* (2013.01)

(56) References Cited

U.S. PATENT DOCUMENTS

| | | | | | |
|---|---|---|---|---|---|
| 2,178,501 | A * | 10/1939 | Staneampiano | E04F 19/045 | 52/241 |
| 2,262,090 | A * | 11/1941 | Brickman | E01C 11/14 | 404/57 |
| 2,355,771 | A * | 8/1944 | Yeoman | E01C 11/14 | 404/47 |
| 2,541,768 | A * | 2/1951 | Keller | A47K 3/008 | 4/695 |
| 2,685,194 | A | 8/1954 | Amirikian | | |
| 3,090,087 | A * | 5/1963 | Miller | E04F 13/06 | 217/69 |
| 3,222,837 | A * | 12/1965 | Daley | A47K 3/008 | 52/250 |
| 4,315,390 | A * | 2/1982 | Schaafsma | E04F 19/022 | 52/255 |
| 4,601,149 | A * | 7/1986 | Dokan | A47K 3/001 | 428/100 |
| 5,283,997 | A * | 2/1994 | Lackie | A47B 95/00 | 52/254 |
| 5,315,390 | A | 5/1994 | Windrem | | |
| 5,572,834 | A | 11/1996 | Lilly | | |
| 5,590,498 | A * | 1/1997 | Mokres | E04D 13/1415 | 52/287.1 |
| 6,408,576 | B1 | 6/2002 | Roth | | |
| 6,490,834 | B1 * | 12/2002 | Dagher | E04H 9/04 | 52/309.1 |
| 6,806,212 | B2 * | 10/2004 | Fyfe | B29C 70/30 | 442/104 |
| 6,860,072 | B2 | 3/2005 | Smerud | | |
| 6,948,287 | B2 * | 9/2005 | Korn | E04B 1/68 | 277/510 |
| 7,797,893 | B2 * | 9/2010 | Stahl, Sr. | F16L 5/04 | 52/219 |
| 8,474,207 | B1 * | 7/2013 | Gilbert | E04G 23/0218 | 52/309.1 |
| 8,584,271 | B2 | 11/2013 | Mathis et al. | | |
| 9,611,667 | B2 * | 4/2017 | GangaRao | E04G 23/0218 | |
| 2007/0175133 | A1 * | 8/2007 | Woytowich | E04F 19/04 | 52/287.1 |
| 2017/0254042 | A1 * | 9/2017 | Jaecklin | E02D 29/025 | |

FOREIGN PATENT DOCUMENTS

| | | | | |
|---|---|---|---|---|
| DE | 10156045 | A1 | 6/2003 | |
| DE | 102011101821 | A1 | 3/2012 | |
| FR | 10156045 | A1 | 2/1968 | |
| GB | 2164677 | A * | 3/1986 | E04F 11/16 |
| JP | 52133377 | A * | 4/1930 | |

OTHER PUBLICATIONS

Ekenel, M, Stephen, V, Myers, JJ, and Zoughi, R, "Microwave NDE of RC Beams Strengthened with CFRP Laminates Containing Surface Defects and Tested under Cyclic Loading." Electrical and Computer Engineering, University of Missouri-Rolla (2004).

Rai, G, "Rehabilitation and Strengthening of Bridges by using FRP Composites", http://www.dgc24.com/rminternational/en/wp-content/uploads/2014/07/Strengthening-Bridges-using-FRP-Composites-Hyd.pdf.

Hota, Gangarao and Liang, Ruifeng "Advanced Fiber Reinforced Polymer Composites for Sustainable Civil Infrastructures", International Symposium on Innovation and Sustainability of Structures in Civil Engineering, Xiamen University, China, 2011.

US Departmnet of Transportation, Federal Highways Administration, "A composite Solution to Repairing Overhead Sign Structures", Publication No. FHWA-HRT-08-011 (Mar. 2008).

Tang, Benjamin and Podolny Jr., Walter, "A Successful Beginning for FRP Composite Materials in Bridge Applications", FHWA Proceedings, International Conference on Corrosion and Rehabilitation of Reinforced Concrete Structures, Dec. 7-11, 1998.

Chowdhury Bisby, Green and Kodur, "Investigation of Insulated FRP-Wrapped Reinforced Concrete Columns in Fire", Fire Safety Journal 42 (2007) 452-460.

"Grove Isle Bridge Rehabilitation", Insituform; http://www.insituform.com/CompanyInformation/Resources/CaseStudies/Grove-Isle-Bridge.aspx.

Transportation Research Board, NCHRP Report 503, "Application of Fiber Reinforced Polymer Composites to the Highway Infrastructure".

Triantafillou, "Composites: A New Possibility for the Shear Strengthening of Concrete, Masonry and Wood.", Composites Science and Technology, 58 (1998) 1285-1295.

Ehsani, Larsen and Palmer, "Strengthening of Old Wood with New Technology—FRP Laminates and Epoxy Help Support New Loads in an Existing Wooden Gymnasium", Structure Magazine, Feb. 2004, 19-21.

"Bridge Replacement Unit Costs 2012", http://www.fhwa.dot.gov/bridge/nbj/sd2012.cfm.

"Frame Wrap Joints", http://feroocement.com/bioFiber/y8-1/wrapJoint.3.en.html.

Li, Jianchun, Bakoss, Steve. L., Samali, Bijan., and Ye, Lin. "Reinforcement of concrete beam-column connections with hybrid FRP sheet." Composite Structures, 1999: 805-812.

Misir, I.S., and Kahraman, A. "Strengthening of non-seismically detailed reinforced concrete bean-columns joints using SIFCON blocks." Sadhana vol. 38, Part 1, 2013: 69-88.

Pantelides, Chris, P., Alameddine, Fadel, Sardo, Tom, and Imbsen, Roy. "Seismic Retrofit of State Street Bridge on Interstate 80." Journal of Bridge Engineering, 2004: 333-342.

Pimanmas, Amorn, and Chaimahawan, Preeda. "Shear strength of beam-column joint with enlarged joint area." Engineering Structures, 2010: 2529-2545.

Sharma, Akanshu, Elingehausen, R, and Hofmann, J. " Numerical Modeling of Joints Retrofitted with Haunch Retrofit Solution." ACI Structural Journal, 2014: 861-872.

Taylor, David, Kelly, Andrew, Toso, Matteo, and Susmel, Luca. "The variable-radius notch: Two new methods reducing stress concentration." Engineering Failure Analysis, 2011: 1009-1017.

Yu, Jiangtao, Shang, Xingyan, and Lu, Zhoudao. "Efficiency of Externally Bonded L-Shaped FRP Laminates in Strengthening Reinforced-Concrete Interior Beam-Column Joints." Journal of Composite Construction, 2015.

* cited by examiner

DURABLE, FIRE RESISTANT, ENERGY ABSORBING AND COST-EFFECTIVE STRENGTHENING SYSTEMS FOR STRUCTURAL JOINTS AND MEMBERS

CROSS-REFERENCE TO RELATED APPLICATION

This application is a divisional application of U.S. patent application Ser. No. 15/147,124 filed May 5, 2016, the entire disclosure of which is hereby incorporated herein by reference.

BACKGROUND OF THE TECHNOLOGY

The disclosed technology regards a durable, fire resistant, energy absorbing and cost-effective strengthening system, useful especially at high stress concentration zones of structural joints and members, and adjoining other connections and re-entrant angles of members, applicable for both in-service structures and new construction. The system is ideally suited to strengthen joints and connections and structural members/components with ledges and re-entrant angles which receive multiple other structural components under multiple load paths, including dynamic load paths resulting from high winds, explosive blasts and earthquakes. Applications include bridge structures, roof trusses, openings and ledges in walls and slabs of buildings, bridges, lattice towers, truss joints and other infrastructure systems, as well as planes, ships and other complex structural systems.

Over the past twenty years, increases in traffic flow and vehicle weight, environmental pollution, application of de-icing agents, low-quality and aged structural materials including expansion joints and waterproofing membranes, and insufficient/inadequate design, maintenance and rehabilitation approaches, have led to the rapid deterioration of bridges and other structures. Repair of these structures to preserve the structure and safeguard human life are becoming a serious technical and costly problem in many countries.

Advanced composites of high grade fibers and fabrics with binders such as thermosets and thermoplastics are beginning to play a significant role in construction applications, particularly in strengthening and rehabilitating existing bridges that have deteriorated due to their age and environmental influences. Current systems of joint repair include haphazardly bonding discontinuous fiber reinforced polymer (FRP) sheets at the re-entrant corners of a joint. FRP laminates are composite materials built from a combination of sheets made from carbon, glass or aramid fibers bonded together with a polymer matrix, such as epoxy, polyester or vinyl ester. As currently used, FRP can be applied to strengthen beams, columns and slabs of building and bridge structural elements and other structural components/members, and can increase the strength of structural members even after they have been severely damaged due to loading or other conditions. Further, application of FRP sheets in this haphazard manner has become a cost-effective material in a number of field applications strengthening concrete, masonry, steel, cast iron and timber structures, and is frequently used to retrofit structures in civil engineering.

When used to strengthen joints and structural components, multiple sheets/strips of FRP are wrapped about a joint, using epoxy or other adhesives; these sheets are typically applied in a haphazard-manner, without utilizing the material's ability to greatly absorb shocks and minimize stress concentration around a junction, and without maximizing the rupture stress resistance of the materials through confinement and damping. Therefore there remains a serious concern in the industry as to the long-term integrity and likelihood of cyclic fatigue loading on joints and components bonded in this manner. Other concerns include application errors, such as improper curing of the resins, moisture absorption and ultraviolet light exposure of the FRP composites that may affect strength and stiffness. For example, certain resin systems in glass fiber composites, are found ineffective in the presence of moisture. These issues could lead to de-bonding or delamination of the FRP sheets from the substrate, as well as shear failure due to inadequate confinement of the core joint.

Furthermore, prior art methods of randomly applying FRP composite sheets about a joint without focusing on minimizing stresses frequently result in lopsided strengthening of the joint, rather than uniformly minimizing stress concentrations (including axial, bending, shear and torsion stresses or their combinations). Similarly, prior art methods include discrete anchoring of steel angles or plates at re-entrant corners after bonding the FRP sheets to the substrate, which lead to stress raisers including stress-corrosion, and eventually to potential delamination between the FRP and the substrate, and even cracking in the member at the long-edge of an angle. Likewise, some prior art methods place a steel angle with sharp edges at the joint, and then wrap the angle with FRP, which leads to cracking at the sharp edges. These steel angle methods lead to premature failure in the fabric due to high stress concentration and the sharp edges of the steel angle, and also stiffness mismatch between a steel angle and its substrate. Engineers have also attempted methods of welding one or more thin steel plates to a steel angle and placing it at the corners of a joint, which leads to local buckling of the web or fracture of the weld. Many classical failure modes at joints have been delayed, using current state of the art, by only small increases in mechanical properties including energy absorption; however, the above-identified limitations in the current state of the art lead to even more dramatic failures under dynamic, shock and environmental loads.

Use of the system of the disclosed technology overcomes these limitations of the prior art. The system of the disclosed technology and installation thereof in accordance with the methods hereinafter described minimizes the stress concentration effects at the re-entrant angles and may provide confinement to the joint-core. This enhances the strength, stiffness, ductility and energy absorption capacity of a joint, while minimizing stress concentration and structural and material deterioration from environmental and fire exposure. Preliminary test results indicate a significant increase in the strength, ductility and energy absorption of the joint.

Furthermore, the system allows non-intrusive, in-situ installation, and in some cases components thereof may also be designed and manufactured in-situ.

GENERAL DESCRIPTION

The disclosed technology regards a system and a method of installation of a system to join or strengthen two or more structural members together, with improved strength, energy absorption, durability and dynamic resistance over the prior art. The system of the disclosed technology may be used at re-entrant angles of structural components with ledges, and/or complex connections, and can include complex-shaped filler modules and a continuous wrap for affixation about a joint, designed and configured for the requirements of each application.

The system of the disclosed technology generally includes a filler module for increasing strength and ductility at the joint which, when coupled with a wrap material applied as herein described will realize much higher magnitudes of strength and ductility, with ease of application of a wrap. Furthermore in some embodiments, one or more dowels may be incorporated into the members of the joint and the filler module, and/or an outer layer of fabric may be applied about the wrapped joint to minimize fire hazard.

The filler module of the disclosed technology can be shaped and designed for each specific joint and its loads, to maximize joint efficiency. The wrap of the system of the disclosed technology is preferably provided in one continuous sheet, or as few sheets as possible. In addition, joint efficiency can be maximized by reinforcing the filler module and the adjoining members with laminate, and then wrapping the continuous sheet(s) of wrap material about the module and the joint.

The disclosed technology further includes methods of installation of the system of the disclosed technology, by securing the dowel rods (if used) to the joint, affixing or securing the filler module to the joint, wrapping the filler module and the members at the joint with a continuous wrap, followed in some embodiments by wrapping an outer layer of fabric to control/maximize confinement pressures, facilitate resin curing and minimize fire hazard. In this configuration, and using a uniform and joint specific pattern for wrapping the filler module and the adjoining members with the wrap, stresses on the joint can be diffused to different load paths.

DETAILED DESCRIPTION

Figure 1A:
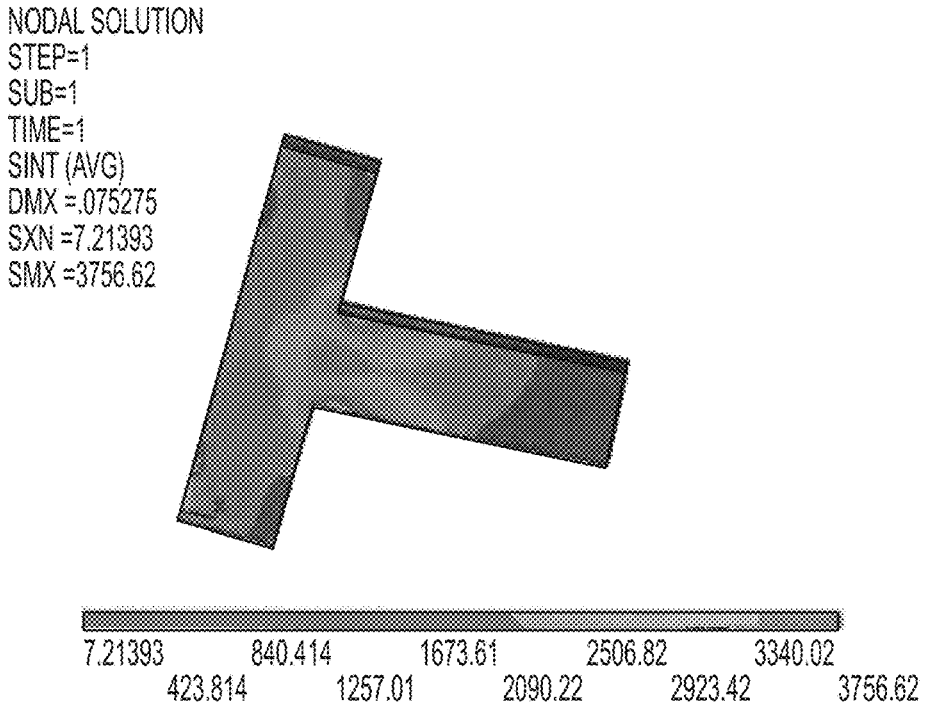
FIG. 1A shows stress distribution around a joint, having a point load applied to the cantilever tip of the joint.

As shown in the Figures, systems of the present technology include a filler module 10, one or more dowels 20, and a wrap 30. The design of the filler module (dimensions, varying cross-sectional thickness, material properties, etc.) is primarily dependent on the following parameters: (1) strength, stiffness and toughness requirements for the joint (static loads vs. dynamic/earthquake loads); (2) structural connections (truss, frame, cable connections, etc.); (3) environmental conditions (durability); and (4) the substrate material of the joint/connection, its condition and its structural integrity. Further, several field related issues should be considered when designing the filler module, including the strength of specific joint and its detail, the size of the joint, and geometric considerations near and around a joint. In new construction, a balance in stiffness between the joint, the members 100 meeting the joint and the filler module 10 has to be maintained, for optimal structural response.

The filler module 10 of the present technology comprises a solid, shock absorbing material, formed, molded or printed into complex geometries (curvilinear and rectilinear three dimensional shapes). The material, material density and geometry of the filler module 10 may be unique to, and specifically designed for, each application, structure and joint, to minimize stress concentration effects and enhance joint damping, as hereinafter described.

Specifically, the module 10 is shaped to correspond with the unique or specific shape of a vacuous area formed at the joint of two or more structural members 100. In this manner, a plurality of sides of the module are formed so that when the module is installed at the joint, these sides (legs) are tangential to the members forming the vacuous area at the joint/connection. In some embodiments the module 10 may be shaped to fill or receive any surface deformations (protrusions or depressions) of the members 100, near the joint, when the module is positioned at the joint. The remaining non-tangential side or sides are shaped to further facilitate the module's absorption of potential loads and shocks, as hereinafter described, designed and configured to be positioned within the plane of the members. In some embodiments, the filler module is defined by two or more legs joined at a throat and extending to extremities, each of the legs having a tangential side intended to be positioned against a member, wherein the legs 10A of the filler module are each about 2 to 2.5 times the maximum thickness of the members 100. The sides of the legs opposing the tangential sides form a non-tangential side, extending between the extremities of the legs. The throat 10B (the 45° distance from the corner of the module, at the joint, to its nontangential side) is about 1 to 1.5 times the maximum thickness of the members 100. Therefore, in a joint wherein the maximum thickness of the members is 8", the module comprises legs 10A having a length of about 16-20", and a throat 10B of about 8-12".

At the joint the throat of the filler module 10 may, in some embodiments, have a thickness equal to or less than the thickness of the members adjoining at the joint. For optimized load bearing capacity and energy absorption, the thickness of the module may decrease from its throat 10B to its ends, thereby distributing loads from the throat of the joint along the legs 10A to the ends 10C, 10D of the member; this thickness may decrease in a curvilinear manner to control energy absorption and load dissipation. For example, thinner modules may have an 8" thickness at its throat, decreasing to a 1" thickness at its ends; a thicker module may have a 16" thickness at its throat, decreasing to an 8" thickness at its ends. In the event cracks, metal fatigue or undesirable stress concentrations are present at the joint, the thickness of the member may be increased to further absorb loads and associated energy. Thickening or broadening the module may maximize dissipation of loads and energy absorption at the joint. In some embodiments the thickness of the module is profiled to follow the stress concentration reduction trends of the joint.

In designing the shape of the filler module and the density and selection of its material, the principal tensile strain direction at the joint, as part of an overall system subjected to loads, is determined and considered. Further considered is the strength and energy absorption of the joint when subjected to varying dynamic, static, impact, and slow moving loads. The dimensions, nontangential sides and material of the filler module of the present technology may then be designed to enhance the load transferability at the joint.

Stress concentration may be present at a joint as a result of cracks and fractures in the members, sharp corners, holes, metal fatigue, and corrosion. The filler module 10 of the disclosed technology may be specifically designed to minimize the weakness presented by one or more identified stress concentrations at or near the joint, and absorb some of the energy of a stress concentration, by modifying the density of the module material to form a load path, by increasing the thickness of the filler module, and/or by extending the length of the module legs 10A, for example to extend at least about 6" past the crack when positioned at the joint. Further or alternatively, the module may be formed from a plurality of materials having varying densities, wherein [denser] material is positioned relative to a crack or other area of stress concentration to reinforce the area and dissipate the load away from the area of weakness.

Figure 2A:
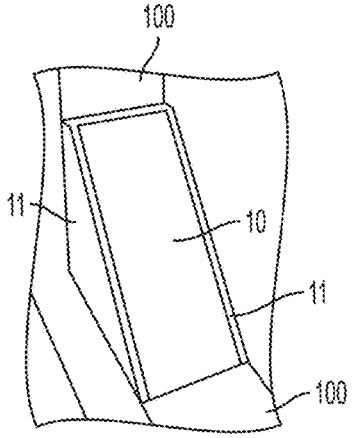
FIG. 2A is a peripheral view an embodiment of the filler module of the disclosed technology, bonded at the reentrant corner of a joint.
Figure 2B:
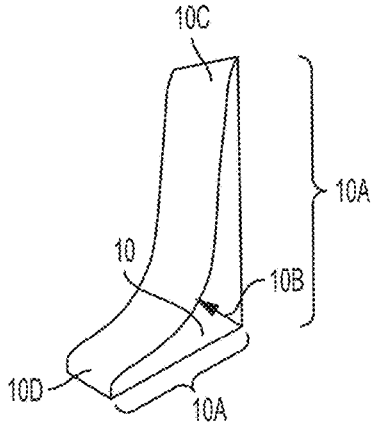
FIG. 2B is a peripheral view of another embodiment of the filler module of the disclosed technology.
Figure 2C:
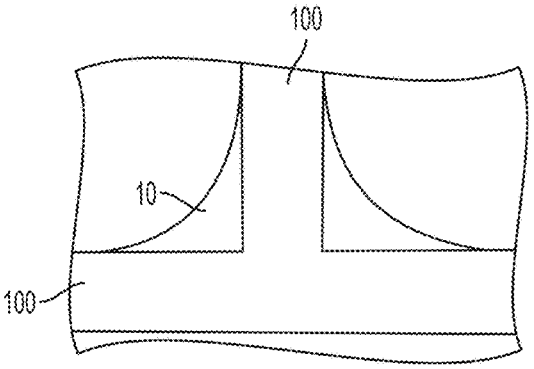
FIG. 2C is a front view of another embodiment of the filler module of the disclosed technology, bonded at two reentrant corners of a joint.
Figure 2D:
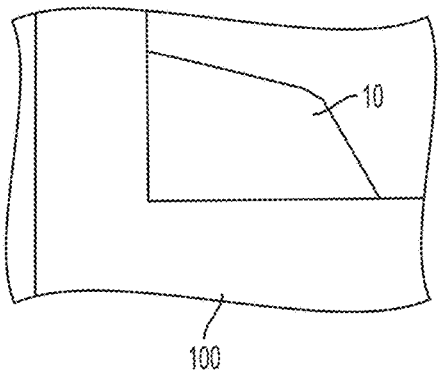
FIG. 2D is a front view of another embodiment of the filler module of the disclosed technology, bonded at a reentrant corner of a joint.

With the tangential sides, the non-tangential side(s) of the module defines the shape of the module and its joint damping and energy dissipating capacity and design. Therefore, while the tangential sides of the filler module are determined by the spatial position of the structural members at the joint (extended or widened to minimize the effects of structurally-induced stress concentration), the non-tangential sides may be specifically designed and configured to absorb and dissipate potential loads and shocks unique to the joint, as shown in FIGS. 2A-2E. For example, the concave configuration of the non-tangential sides shown in FIGS. 2B and 2C is useful in complex hydrostatic loading, such as dam walls or other vertical walls containing water. The convex configuration of the non-tangential sides shown in FIG. 2D may be useful if loads are received from below the joint. As shown in FIG. 2A, a simple wedge configuration of the module may be appropriate in many structural bridge applications. In some embodiments the module has rounded corners. A non-optimized corner (one not requiring significant stress transfer) may be generally a circular geometry, whereas an optimized corner (such as at the throat 10B of the module) may have a variable radius curve in order to reduce the stress concentration zones at re-entrant angles outwards and away from a junction. The variable radius curve of the optimized module corner is preferably dependent upon the above-referenced structural parameters as well as geometric parameters of the joint. While a 45° wedge may be suitable in some applications, a more effective module shape may include a smoother angular transition, beginning for example at 5°, and increasing to 45° or more.

Figure 2E:
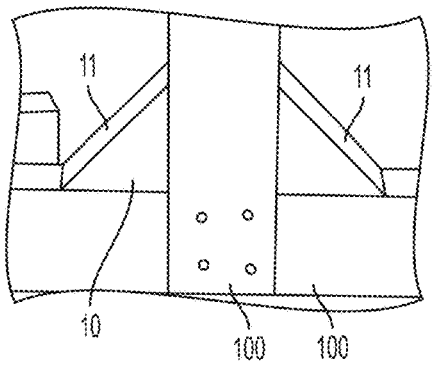
FIG. 2E is a front view of another embodiment of the filler module of the disclosed technology, bonded at two reentrant corners of a joint.

As shown in FIGS. 2A and 2E, the module may be encased at the joint, on one or more sides, with a cap 11 to contain the wedge, thereby providing increased load transfer capability and containing the filler module. The cap may be a composite material, a polymeric material, carbon, glass or a natural or engineered fiber-based material, wherein lighter materials are selected for use in weight sensitive structures. For example, in high stress environments, the cap may be carbon or similar material having desired strength, stiffness and weight characteristics based upon the application; in low stress environments, where weight is not critical, the cap may be glass. Therefore, on airplanes where structures are exposed to significant loads, and weight is of utmost importance, carbon may be appropriate. In structures supporting human foot traffic, the weight and load may be much less critical, and glass capping of the filler module may be appropriate. The cap may be integrated into the members, which may be critical for aircraft structures, high-speed vehicles, naval ships or structures requiring watertight and/or windtight configurations. In this embodiment the integrated cap holds the filler module in place and compresses it against the members, thereby distributing stresses more easily and evenly. In the embodiment shown in FIG. 2A, lateral caps may be affixed at the joint in the desired shape of the filler module, and the vacuous area formed thereby may be filled with the desired foam, in situ, to form the filler module.

By its joint-specific configuration, with the tangential sides of the module formed to fit against the structural members and sized to address any stress concentrations present at or near the joint, and further by its designed non-tangential sides, the filler module provides effective, passive joint damping by dissipating the energy of the anticipated loads and shocks, with enhanced absorption and load transfer at weakened areas of the members, and further advances moment capacity at the joint.

Further imperative in designing an effective filler module of the present technology is the selection of materials, and the module material strength, stiffness and damping coefficient. The filler module can be produced from conventional structural materials of different grades including various species of timber, concrete (4 ksi-8 ksi) with or without high strength fiber material, reinforced polymers, polymer foams (e.g., polyurethanes, polystyrenes) with or without glass beads, steel (40-70 ksi), aluminum and other metals and materials, such as wood, concrete, polymer composite foams, natural fiber polymer composites, recycled cast iron, and ceramics. In some embodiments the shock absorbing material of the filler module is a polymer, including polymer foams such as polyethylene; however other foams and plastics may be suitable, with or without reinforcement. When used, the mass density of a selected polymer material depends upon the field application and the structural functionality.

A combination of material densities may also be appropriate for highly sophisticated systems, wherein weight is critical or the minutia of load bearing control is critical (e.g., airplanes). When a module having a combination of material densities is designed, the strength/stiffness variations of the material should follow the stress patterns from the induced load. For example, very high load transfer junctions require very high strength fabrics and filler material, which may range for example from 2-200 oz/yd$^2$ The inventors have tested filler modules of a polymer material, wood, or concrete and determined that the modules have high strength resistance (e.g., 3-4 times the strength resistance of timber), with high damping capability.

When selecting module materials suitable for use in a particular application of the present technology, the material of the structural members 100 should be considered. The selection of the module material should have stiffness and strength characteristics corresponding to the stiffness and strength characteristics of the members; in some embodiments the module material has a stiffness of ±10% of the stiffness of the members; in some embodiments the module material may have a stiffness of ±20% of the members, such as in old structures where moment transfer between the members and the module is desired. When the structural members 100 are made from timber, for example, the module material may be compatible timber or low density foams (2-5 lbs/ft$^3$); when the members 100 are made from concrete or steel, the filler modules 10 should be concrete or very high density composite foams (30-60 lbs/ft$^3$).

Specifically, the module should have strength characteristics corresponding to the characteristics of the members at the joint, observing yield, compressive, tensile, fatigue and/or impact strength, depending upon the structure design and anticipated loads. Preferably the module 10 has tensile strength of at least 50% of the tensile strength of the members, and 160-200% of the compressive strength of the member 100. The stiffness of the module material should also be considered, and should be comparable to the stiffness of the members 100. If the members and the module have similar stiffness qualities, they together will flex when subjected to loads, thereby minimizing stress concentrations and providing a longer service life; however, a module having greater stiffness than the members may fail prematurely, and/or having less stiffness than the members will not bear the load from the members. The density of the filler module material contributes to the strength and stiffness of the module, is an aspect of determining the load bearing capability of the module, and enhances the integrity and load bearing capability of the joint. Further, variations in material density within a module can direct the energy path of the load, which may be considered and incorporated into the design of the module when optimizing the same.

While strength of the module materials is important, there's a significantly different but equally imperative need for high damping capability to transfer load energy to other members of the joint. For complex methods of design, at least 2%-10% off critical damping is desired; for joints designed to support structures through earthquakes and other natural disasters, 10-20% of critical damping is desired. The module and the joint should be tested to ensure there is sufficient dissipation of energy. In some embodiments the modules are designed with damage tolerance, wherein under high impact stress, natural disasters or other unusual loads, the module may fail or crack, but will not collapse. As damping increases within a material, strength decreases, and therefore balance between strength and damping is imperative; however, lost strength in higher damping material selection may be wholly or partially replaced with wraps as hereinafter described.

Conditions such as corrosion, fractures, and other factors at a joint leading to stress concentration should be considered when determining load absorption requirements of the module, which will also direct material selection and design. Therefore, for example, when a joint is exposed to lighter loads (e.g., a timber truss of roofing systems) filler modules may be made of lighter foams with 2-5 lbs/ft$^3$ density, or wood. Heavier loads (such as bridges, planes, high rise buildings) require denser material such as higher density foams ranging from 30-60 lbs/ft$^3$. Extensive corrosion or fractures in the members may require a denser (stronger) material in the module design. For economical design, material strength should be optimized for all types of loads that induce member stresses. However, joints and connections that may be subjected to transient loads caused by earthquakes, tornadoes, windstorms, and explosives, may have to be designed with higher damping materials nearly compatible in stiffness with member substrates, i.e., compatible curvature when loaded.

Foams suitable for use in the disclosed technology may be syntactic foams made from polymer resin and glass beads, wherein the resin is present at 30%-35%, and the beads are present at 70%-65% for low-density foams; or vice versa for high-density foams. In certain embodiments the resin is present between 20-80% of the syntactic foam, with glass being present between 80-20% of the foam. The presence of hollow particles such as glass beads with the foam composite results in lower density, higher specific strength, and lower coefficient of thermal expansion.

To design an optimal filler module for a specific joint, or a plurality of joints or connections on a structure, intricate numerical modeling such as finite element or finite difference analysis are useful to determine the response of the filler module when installed in the vacuous area of the specific members, under their current conditions, and under a variety of anticipated loads and stresses. Through this analysis the structure in its current condition, as well as filler modules designed and configured to dampen and dissipate load energy and stress as hereinabove described, are input and modified. Thereby, a balance between strength, stiffness and damping can be achieved, and optimal load resistances emphasizing principal tension and compression failure criterion may be realized. This analysis may be conducted by means of computer programs such as ANSYS, LS-DYNA and Abaqus FEA, and other commercially available software.

Filler modules can be manufactured by compression molding processes, 3D printing, casting, vacuum infusion (at high or room temperatures), foam spray, and other known or hereinafter developed methods. The filler module of the disclosed technology may be prefabricated, or may be manufactured in-situ, after photographing a joint location with a 3D camera and electronically or physically replicating the angles and surfaces thereof to form the surfaces and configuration of the filler module, using the afore-referenced or similar computer programs.

Figure 3A:
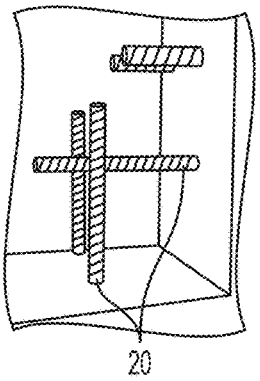
FIG. 3A is a front view of dowel bars of the disclosed technology, installed on members at a joint in accordance with methods of the disclosed technology.
Figure 3B:
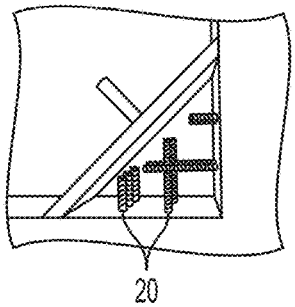
FIG. 3B is a front view of dowel bars of the disclosed technology and framing for the filler module, installed on members at a joint in accordance with methods of the disclosed technology.
Figure 3C:
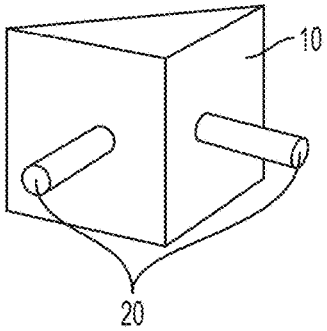
FIG. 3C is a perspective view of dowel bars of the disclosed technology, installed on a filler module for use in the disclosed technology.

As shown in FIGS. 3A, 3B and 3C, dowel bars 20 may also be used in the system of the disclosed technology. The dowel bars are provided for effective shear/moment transfer between beam-column elements of a structural system at or near any re-entrant corner or junction. These bars can be made of glass, carbon, natural fibers, steel or other conventional materials like wood The dowel bars 20 are inserted in and around any junction by pre-drilling holes into the substrate about the joint area and grouting with paste to provide an adequate bond of the dowel bars to or through the substrate. In some embodiments the dowel bars are juxtaposed to provide added strength, as shown in FIGS. 3A and 3B. The dowel bar diameter and material are primarily dependent on the parameters described above for the design and configuration of the filler module, namely: (1) strength, stiffness and toughness requirements; (2) structural connections; (3) environmental conditions; and (4) substrate material and its structural integrity. In some embodiments the dowel bars extend between 50-85% of the filler module dimensions.

Like the choice of the filler module, the material of the bars should balance the stiffness of the members and the filler modules, so that the bars will not prematurely fail, but will flex with the other components at the joint (the members and the module). Further, the diameter of the bar may be designed based upon the stiffness/flexibility of the bar. It should be noted that the installation of the dowel bars in the members 100 and the filler module 10 results in a decrease in flexibility around the areas of installation, and therefore the strength provided by a larger diameter series of bars should be balanced with the resulting decrease in flexibility of the member and module, to find an optimized diameter. As hereinabove stated, designing the system of the disclosed technology to flex in unison with the members of the joint provides a more uniform load distribution, enhances the strength of the joint and the module, and provides a longer service life of the structure, its members and the modules.

Figure 4A:
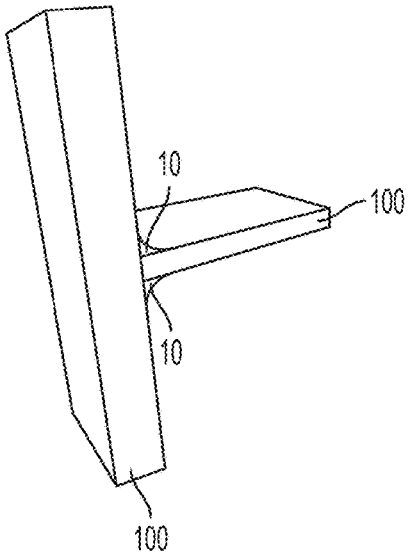
FIG. 4A is a perspective view of an embodiment of the system of the disclosed technology, installed at a joint of a structure.
Figure 4B:
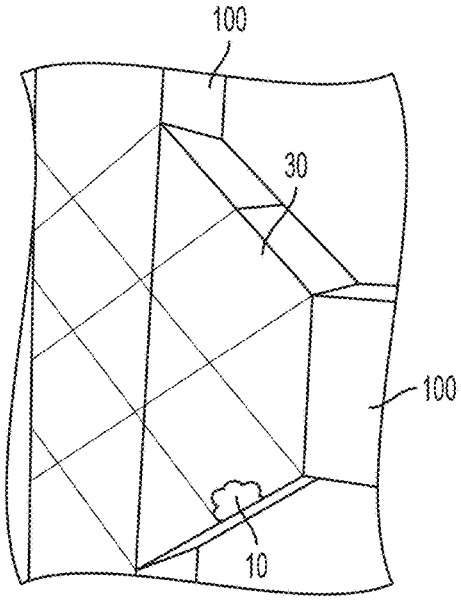
FIG. 4B is a perspective view of an embodiment of the system of the disclosed technology, installed at a joint of a structure.

The use of dowel bars can enhance the strength of the joint when used in combination with the filler module. However, they can also create undesirable stress concentrations; the wraps 30 of the disclosed technology can counterbalance these stress concentrations, as shown in FIG. 4B. The weave or stitch of the wrap material is selected based upon the same parameters hereinabove discussed for the filler module (e.g., strength requirements, substrate material, etc.). FRP (e.g., 5, 20, 40 or 80 oz/yd$^2$) is particularly suitable as the wrap material in the disclosed technology. The wrap material is preferably continuous, and cut in its plane to fit the complex geometries of a jointing system, and avoid fabric bulging; these in-plane cuts can be bonded around the junction to cover high stress concentration zones. By this wrap material, the joint and its members are protected against further corrosion, and with the filler module, load absorption is achieved. When cracks or other areas of stress concentration are present at the joint, wrap material may further be more tightly wound or layered over the crack to enhance the strength of the system and compensate for the weakness in the members of the joint.

The selection of a suitable FRP wrap, including its fabric configuration (material, orientation of fibers, resin properties) and density, as well as the appropriate number of layers, may be determined depending upon the functionality of the structure (strength, stiffness and toughness requirements) and its field condition, especially the extent of its deterioration and the magnitude of increase in strength, as needed. These fabric configurations can be produced by pre-impregnation/pre-saturation with resin, in-situ hand layup of saturated fabrics or vacuum infusion. The resin of the fabric may be polyurethane in hermetically sealed packaging, which upon application cures when exposed to air or water. The density of the FRP wrap defines its strength, and should match the strength and dampening of the members and the filler module. While multiple layers of wrap make the reinforced joint stronger, maximum strength enhancement of the wrap is typically reached at 3-5 layers of wrap. The orientation of the wrap may be biaxial, quadriaxial, or quasi isotropic. Orientation of the higher percent fiber direction may be perpendicular to a crack of the member, or parallel to stress, resulting in enhanced strength for the joint. The fabric density and orientation should take into consideration the principal tensile strain direction at the joint, as determined and considered in designing the shape of the filler module.

Using a single piece of FRP wrap material wound firmly and evenly about a joint, the fabric orientation of the wrap material should be strategically positioned to strengthen weaknesses in the members and the computed principal tensile strain at the joint. Further, with multiple layers of wrap material so wound about the members and the module, the joint substrate is confined and additional load bearing capacity on the joint is achieved. By this same configuration, issues of delamination of the prior art are avoided.

Additionally, the system of the disclosed technology may include an outer layer fabric. FRP is a suitable material for this layer as well as the wrap layer. This outer layer is applied as a stricture wrap, to allow the resin to cure on the fabric, and can be removed; however, maintaining this layer on the joint in service may protect against UV degradation. The outer layer fabric may also include anisotropic-heat dissipative material oriented along the surface of the fabric to diffuse heat along the fabric plane and not through its thickness, thereby providing significant fire resistance to the joint and the present system. In some embodiments the outer layer fabric further includes nano-carbon tubes, for example a layer of nano-carbon composite sheathing may be applied to the exterior of the outer layer fabric. This material can be produced by electrically conducting nano-tubes to orient in a plane with maximum heat diffusion.

The disclosed technology further regards a method of strengthening a joint of a bridge, trestle, or other structural component, by bonding or otherwise affixing the filler module hereinabove described at a joint, as shown in FIG. 4B. The filler module may be bonded to the joint by means of commercially available adhesives, including polyurethane-based adhesives, epoxies, or cementitious compounds, or fastened to the underlying substrate at re-entrant angles of a joint, or both bonded and fastened. The module can be customized or designed for use at re-entrant angles of any complex geometric connections (e.g., beam column joints or truss joints, or even to a structural member with re-entrant angles).

Once the filler module is secured to the joint (or before the module is so secured), dowel bars hereinabove described may be secured to the juncture and the filler module, preferably in a juxtaposed manner. While a plurality of dowel bars may be suitable, a concentration thereof is not beneficial to the system, and they should be spaced equidistantly along the length of the members. Further, they should not be spaced less than 25% of the depth of the beam, or greater than 100% of the depth of the beam. In most applications the dowel bars are positioned perpendicular to the member to which they are affixed and formed within; however, in some embodiments angular affixation may be appropriate.

The module, dowel bars and joint are then wrapped with one or more layers of a continuous wrap material (or a plurality of materials), with portions of the fabric cut to fit complex geometries of the joint system, and reinforce the high stress concentration zones of the joint. The continuous wrap causes the system of the disclosed technology and the joint to behave integrally, and to minimizes stress concentration effects while protecting the joint from corrosion, debris collection, and bird excreta. The wrap may be positioned about the joint to distribute the stresses in a more uniform manner, and may have an adhesive with the wrap, or may need to be secured to the junction and the module (and to itself in layered configurations) with resin. In some configurations the wrap is wound 360° about the joint and the module; in some configurations the wrap is wound about 270° about the joint, then back in the opposing direction about the joint and module, where other structure at the joint precludes 360° wrapping. By confining the filler module and a section or joint with the wrap material, sufficiently large compressive forces are provided around the perimeter of the section or a joint, causing the rupture strength of the section or joint to increase.

The outer layer of fabric is then wrapped around the filler and joint substrate in one or more layers to provide fire resistance; in some embodiments a layer of nano-carbon composite sheathing is wrapped about the outer layer of fabric as the final finished layer. Installation of the system of the disclosed technology, by the methods herein described, enhances the strength, stiffness, ductility and energy absorption of a joint, while minimizing structural and material deterioration and stress concentration.

Test results demonstrate the use of the system of the disclosed technology, as integrated with a structural joint in accordance with the method of the disclosed technology, provides a strength increase in a joint of about 3-8 times the original strength or energy absorption; the inventors believe that it could be as high as 10-15 times based on the strength of the substrate, by optimizing the module design and configuration, the wrap configuration and application, the bonding mechanisms, etc.

Based upon testing of eleven beam-column joint specimens (five timber, six concrete), up to a threefold increase in the junction capacity was achieved with filler block coupled with the wrap over an un-filled joint for concrete joints, and a six to seven fold increase was achieved with timber joints. However, it is believed that an eightfold strength increase can be realized with optimal filler block geometries coupled with the continuous wrap, even for concrete joints.

Figure 1B:
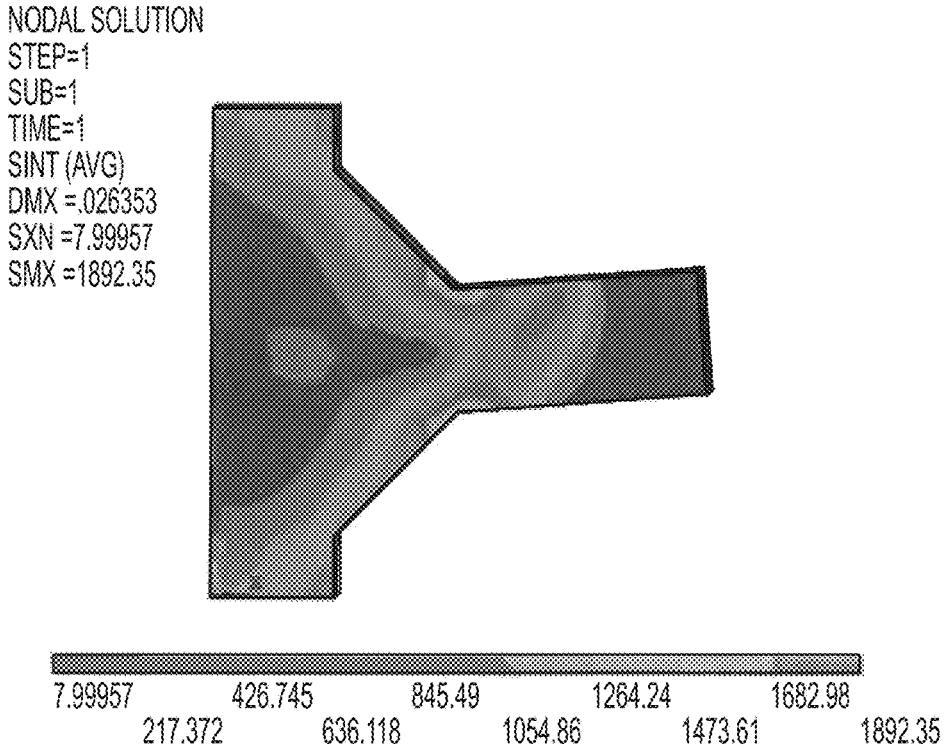
FIG. 1B shows stress distribution around a joint with the system of the disclosed technology installed at the joint in accordance with the methods of the disclosed technology, having a point load applied at the cantilever tip of the joint.
Figure 5:
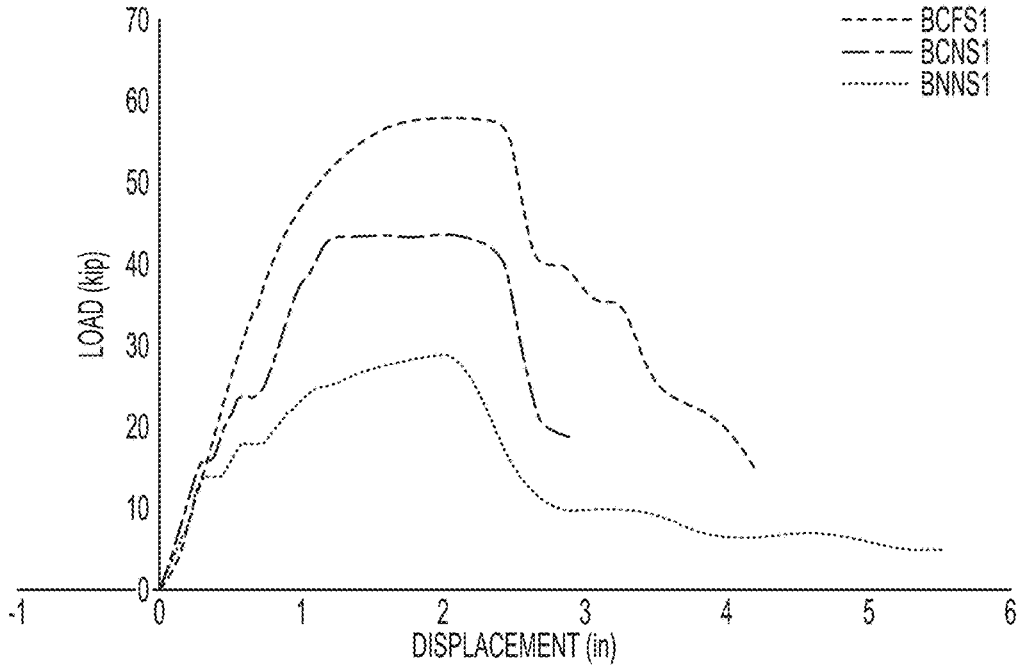
FIG. 5 is a graph showing load (kip) and corresponding displacement (inches) of an unreinforced joint, and two embodiments of the system of the disclosed technology reinforcing a structural joint, wherein the unreinforced concrete joint is BCNS1, a joint reinforced with a concrete module but without a wrap is shown as BCFS1, and a joint reinforced with a concrete filler module and GFRP wrap, installed in accordance with the methods of the disclosed technology is BNNS1.
Figure 6:
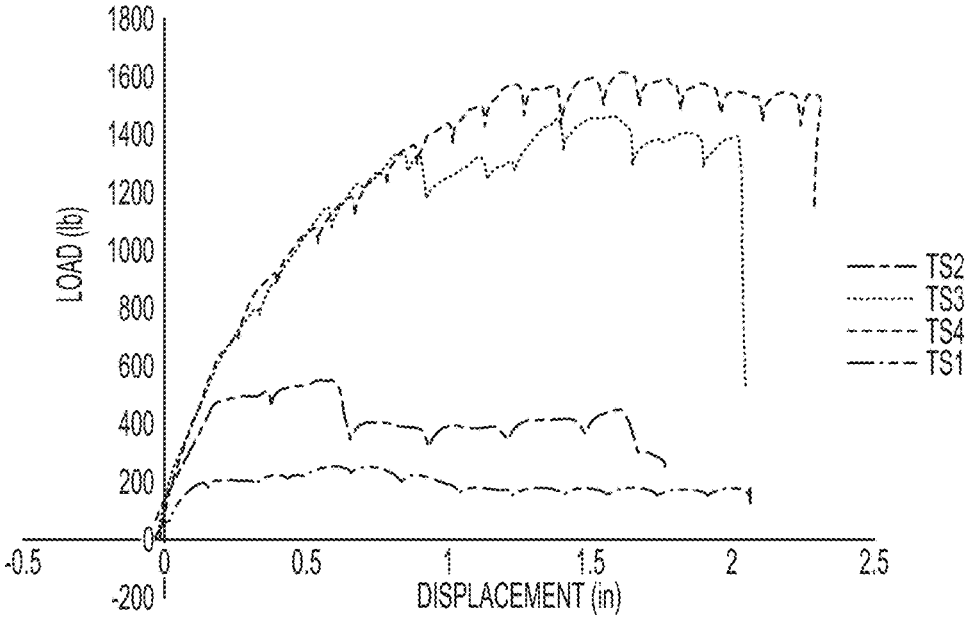
FIG. 6 is a graph showing load (lb) and corresponding displacement (inches) of four timber joints, with three systems of the disclosed technology installed, wherein TS1 was the timber joint without a filler module or wrap, TS2 incorporated a timber filler module at the joint, TS3 incorporated a timber filler module at the joint with three layers of GFRP wrap about the module and the joint, and TS4 included a timber filler module with dowel rods at the joint.

As illustrated generally in FIGS. 1A and 1B, and shown from the laboratory data in FIGS. 5 and 6 and below in Table 1, the load capacity increases by a factor of at least two and perhaps three times when the system and method provided by the present technology are incorporated into a joint, as compared to the load capacity of an un-filled joint under impact loads. However, these increases can be as high as six to eight times the strength, stiffness and energy absorption of unstiffened and unwrapped field joints as compared to the current state of the art. Based upon the present technology, structural property enhancements can vary from two to eight times, or higher, the load bearing capacity of an unfilled joint, depending upon the filler module material type, substrate type, and whether wraps and/or dowels are used in the system. In some embodiments, where the force transfers are low (e.g., housing roof timber trusses), the wrap and dowels may not be required.

TABLE 1

| Reinforced Concrete Sample | Load (kip) | Deflection under max load (in) |
|---|---|---|
| BNNS1 (no filler, no FRP wrap) | 28.20 | 2.02 |
| BCNS1 (concrete filler, no FRP wrap) | 43.55 | 1.96 |
| BCFS1 (concrete filler, 3 layers of GFRP wrap) | 57.8 | 1.92 |
| Impact (Foam filler, no dowel bars, 3 layers of GFRP wrap) | 73.64 | N.A. |

| Timber Sample | Load (lb) | Deflection under max load (in) |
|---|---|---|
| TS1 (no filler, no wrap) | 251 | 2.012 |
| TS2 (Timber filler, no wrap) | 551.89 | 1.716 |
| TS3 (Timber filler, 3 layers of GFRP wrap) | 1455.375 | 1.994 |
| TS4 (Timber filler with shear stud, no wrap) | 1607.5 | 2.272 |

While embodiments of the system and method of the present technology are described and shown in the present disclosure, the claimed invention of the present technology is intended to be only limited by the claims as follows.

The present invention includes a method for strengthening one or more joints or a structure including a plurality or structural members forming a vacuous area at each joint. This method includes the following steps: (a) computing limit load bearing capacity for the structure, at a joint; (b) securing a filler module to the joint, at the vacuous area, the filler module having a plurality or surfaces so that when vacuous secured within the area, some of the surfaces are tangential to the members of the structure at its joint, and one or more of the surfaces are non-tangential to the members of the structure; and (c) applying at least one layer or continuous fiber reinforced polymer wrap about the filler module and the members at the joint; wherein the filler module is designed and configured to dissipate energy from a load applied to the structure, and increasing the load bearing capacity for the structure, at the joint. In some embodiments the method also includes the step or securing a plurality of dowel bars to the members, near the joint, and securing the filler module to the dowel bars. In some embodiments the fiber reinforced polymer wrap is applied in two or more layers about the filler module and the members, wherein each layer comprises a continuous sheet of fiber reinforced polymer wrap. In some embodiments at least one non-tangential surface is concave. In embodiments the member comprises a material having a certain stiffness, and the filler module comprises a material having a stiffness of ±10% of the certain stiffness of the member. In some embodiments the filler module has a throat and legs extending from the throat to its extremities, and further the filler module may be defined by a decreasing thickness from its throat to the extremities of the legs. In some embodiments the filler module comprises material having 2%-10% of critical damping. In some embodiments the filler module comprises one or more syntactic foams made from a polymer resin and glass beads comprising 30-35% resin and 65-70% glass beads. In some embodiments the method further includes the step of applying an outer layer or nano-carbon composite sheeting about the joint, the module and the continuous fiber reinforced polymer wrap.

The invention claimed is:

1. A filler module for strengthening a vacuous area of a joint comprising two or more structural members defined by a certain thickness, tensile strength, compressive strength, and stiffness;

wherein the filler module comprises two or more legs joined at a throat and extending to extremities, wherein the legs each have a tangential side intended to be positioned against a member, wherein a side of the legs opposing the tangential sides form a non-tangential side of the module, extending between the extremities of the legs, wherein the filler module is made from a material selected from the group consisting of concrete, fiber reinforced polymers, polymer foams, natural fibers, wood, metals, ceramics, glass beads and combinations thereof, and wherein the material selected for the filler module has a stiffness of within 20% of the stiffness of the members, a tensile strength of at least 50% of the tensile strength of the members, damping of 2-20% of critical damping, and a compressive strength of between 160-200% of the compressive strength of the members.

2. The filler module of claim 1, wherein the module is formed from a plurality of materials having varying densities, and wherein denser material is positioned relative to an area of high stress on a member.

3. The filler module of claim 1, wherein the module has a decreasing thickness from the throat to the leg extremities to absorb energy and load dissipation.

4. The filler module of claim 3, wherein the thickness of the module is profiled to follow stress concentration reduction trends of the joint.

5. The filler module of claim 3, wherein the module is shaped as a wedge.

6. The filler module of claim 1, wherein the module is formed, molded, cast, vacuum infused, foam sprayed or printed such that two tangential sides of the module fit securely within the vacuous area of the joint and receive any surface deformations of the members.

7. The filler module of claim 1, wherein the module is manufactured in-situ, after photographing the joint with a 3D camera and electronically or physically replicating the angles and surfaces thereof to form the surfaces and configuration of the filler module, and wherein the filler module is shaped to fill or receive surface deformations of the members.

8. The filler module of claim 1, wherein the legs are defined by a length of at least 2 times the thickness of the members; and wherein the throat is defined by a thickness of at least the thickness of the members.

9. The filler module of claim 1, wherein the nontangential side of the module is concave.

10. The filler module of claim 1, wherein the nontangential side of the module has a smooth angular transition increasing from its ends to its throat to at least 45 degrees.

11. The filler module of claim 1, wherein the nontagential side comprises a plurality of rounded edges.

12. The filler module of claim 1, wherein the filler module comprises an engineered fiber-based material.

13. A system for reinforcing a structural joint comprising two or more structural members defined by a certain thickness, stiffness, tensile strength, and compressive strength, the system comprising:

a. a filler module having a stiffness of within 20% of the stiffness of the members, a tensile strength of at least 50% of the tensile strength of the members, damping of 2-20% of critical damping, and a compressive strength of between 160-200% of the compressive strength of the members; and b. a plurality of dowels for incorporation into the members of the joint and the filler module.

14. A system for reinforcing a structural joint having two or more structural members defined by a certain thickness, tensile strength, compressive strength, load capacity, energy absorption and stiffness, the system comprising:

a. a filler module designed and configured to secure to the members of the joint, the filler module having a stiffness within 20% of the stiffness of the members, a tensile strength of at least 50% of the tensile strength of the members, damping of 2-20% of critical damping, and a compressive strength of between 160-200% of the compressive strength of the members; and b. one or more strips of wrap material of sufficient length to apply about the filler module and the members of the joint, wherein the wrap material comprises fiber reinforced polymer.

15. The system of claim 14, wherein the fiber reinforced polymer wrap material is produced by in-situ saturation with resin.

16. The system of claim 14, wherein the fiber reinforced polymer wrap material comprises an orientation selected from the group consisting of uniaxial, biaxial, quadriaxial, or quasi isotropic orientations.

17. The system of claim 14, wherein the filler module comprises two or more legs joined at a throat and extending to extremities, wherein the legs each have a tangential side intended to be positioned against a member, and wherein a side of the legs opposing the tangential sides form a non-tangential side of the module, extending between the extremities of the legs, the system further comprising a cap having lateral side walls perpendicular to the tangential and non-tangential sides of the legs to contain the module, wherein the cap is made of a composite material, a polymeric material, carbon, glass or a natural or engineered fiber-based material.

18. The system of claim 14, further comprising an outer layer fabric with an anisotropic-heat dissipative material oriented along the surface of the fabric to diffuse heat along the fabric plane.

19. The system of claim 18, wherein the outer layer fabric comprises nano-carbon materials.

20. The system of claim 14, wherein when the filler module is secured at a joint, and when the filler module and the members are wrapped with the wrap material at the joint, the resulting energy absorption of the joint is increased by at least two times the original energy absorption of the joint, and the load capacity of the joint is increased by a factor of at least two times the load capacity of the joint.

* * * * *